United States Patent [19]

Fiehler et al.

[11] 3,998,345

[45] Dec. 21, 1976

[54] SIDE LOADER FOR FORK LIFT TRUCKS

[75] Inventors: Raymond H. Fiehler, Kirkwood; Thomas E. Quick, Florissant; Kenneth A. Frees, St. Charles, all of Mo.

[73] Assignee: Missouri Research Laboratories, Inc., St. Louis, Mo.

[22] Filed: June 2, 1975

[21] Appl. No.: 582,833

Related U.S. Application Data

[63] Continuation of Ser. No. 458,204, April 5, 1974, abandoned.

[52] U.S. Cl. ..... 214/701 P; 214/730

[51] Int. Cl.[2] ..... B66F 9/16

[58] Field of Search ..... 214/750, 730, 731, 660, 214/701 P, 620, 621, 127, 142; 212/48, 49

[56] References Cited

UNITED STATES PATENTS

| | | | |
|---|---|---|---|
| 2,709,017 | 5/1955 | Ulinksi | 214/730 |
| 3,390,798 | 7/1968 | Dixon | 214/730 |
| 3,521,779 | 7/1970 | Warren et al. | 214/730 |
| 3,528,579 | 9/1970 | Ulinski | 214/730 |
| 3,559,817 | 2/1971 | Brown | 212/55 |
| 3,599,818 | 8/1971 | Stanton | 214/620 |
| 3,726,427 | 4/1973 | Carlund | 214/701 P |

*Primary Examiner*—Robert J. Spar
*Assistant Examiner*—Lawrence J. Oresky
*Attorney, Agent, or Firm*—Ralph W. Kalish

[57] ABSTRACT

A side loader for use with fork lift trucks or the like having a support frame and a rotatable frame mounted on the support frame for rotation with respect to the support frame about a vertical axis. A reach apparatus is mounted at its inner end upon the rotatable frame for extending and retracting movement along a substantially horizontal axis, and a fork bar frame carried upon the reach apparatus includes fluid actuated means for tilting the fork bars thereon. A unique actuator system is provided for rotating the rotatable frame with respect to the support frame.

15 Claims, 12 Drawing Figures

SIDE LOADER FOR FORK LIFT TRUCKS

This ia a continuation application of Ser. No. 458.204 filed Apr. 5, 1974, now abandoned.

BACKGROUND AND SUMMARY OF THE INVENTION

This invention relates in general to materials handling equipment and, more particularly, to a side loading mechanism for use with fork lift trucks.

Heretofore the utilization of fork lift trucks for transferring loads into, and from, storage within warehouses has necessitated the provision of relatively wide aisles — with attendant loss of storage space — to permit of the full radius for turning of the trucks for operation at an angle of 90° to the aisle's axis.

The necessity of such relatively wide aisles thus has proven most uneconomical from the standpoint of storage and some efforts have been made to develop special trucks adapted for side loading. Understandably, the provision of specialized equipment of this character has proved relatively costly as well as caused the encountering of certain problems, primiarily the reduction of stability in supporting a load at a relatively extended distance to the particular side of the truck centerline. This instability becomes more critical with higher mast elevations, as a truck tipping reaction is caused by the inertia of the load. Therefore, it is of extreme importance that the truck and the associated attachment be so uniquely constructed as to provide a restoring moment resistant to any truck tipping tendency.

Therefore, it is an object of the present invention to provide a side loader for mounted disposition upon conventional fork lift trucks whereby the use of the same will only require that aisles within storage spaces be of adequate width for accommodating the transverse extent of such conventional trucks.

It is another object of the present invention to provide a side loader of the character stated which permits of loading and unloading operation by a fork lift truck in any direction up to 90° to either side of the truck centerline.

It is a further object of the present invention to provide a side loader of the character stated which may be readily disposed upon existing fork lift trucks without requiring extensive and costly modification thereof, and the use of which obviates the necessity for specialized types of trucks.

It is a still further object of the present invention to provide a side loader of the character stated which is uniquely constructed and integrated with a conventional fork lift truck to permit of handling of loads at a substantial distance to either side of the truck centerline without conducing to instability.

It is another object of the present invention to provide a side loader for conventional fork lift trucks which can accommodate pallets of any current size and which embodies means for providing a fork reach of marked extent.

It is a further object of the present invention to provide a side loader of the type stated which is adapted to handle loads from floor level to an elevation consonant with the height of the usual storage area.

It is a still further object of the present invention to provide a side loader of the character stated which embodies a mechanism for tilting the forks for stable accommodation of the applied load.

It is a still further object of the present invention to provide a side loader for use with conventional fork lift trucks which possesses a marked simplicity of parts so as to be durable in usage and resistant to breakdown; which may be economically produced; and which is reliable in use.

DESCRIPTION OF THE PREFERRED EMBODIMENT

Figure 6:
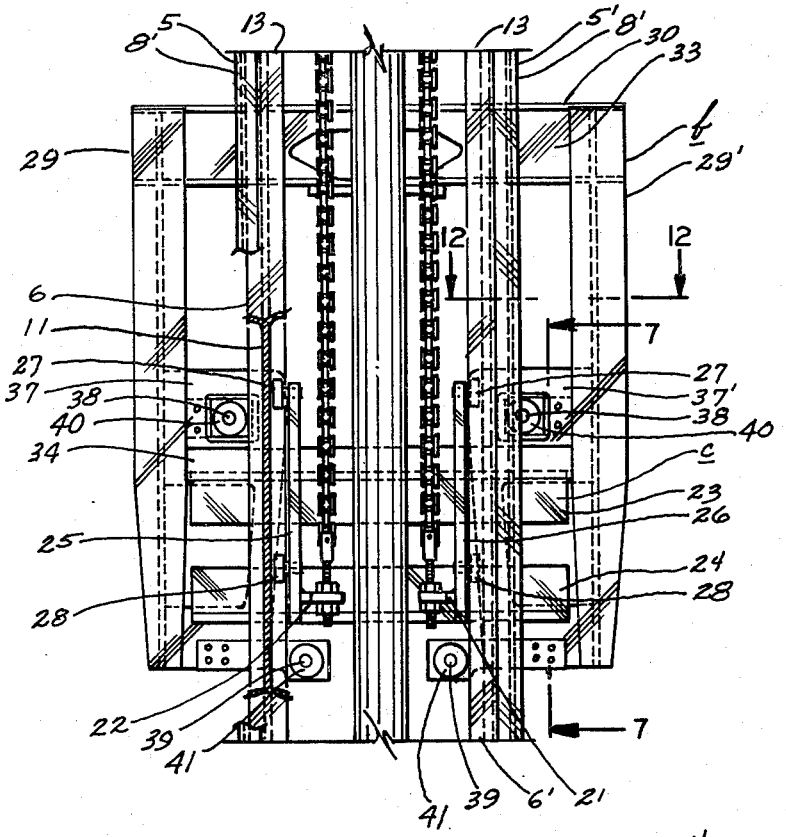
FIG. 6 is a rear elevational view as taken on the line 6—6 of FIG. 1.

Referring now by reference characters to the drawings which illustrate the preferred embodiment of the present invention, A broadly designates a side loader for use upon a conventional fork lift truck, as indicated at B; the latter having a body 1 mounted upon a chassis (not shown) which latter carries forward and rearward pairs of supporting wheels 2,3, respectively. Suitably mounted on the forward end of truck body 1 for extension upwardly thereof is a mast 4 comprising a pair of transversely spaced-apart, rigid, outer channels 5,5′ and a pair of inner extension members 6, 6′ in telescoping relationship to said outer channels 5,5′, respectively. Each of said outer channels 5,5′ comprises a web 7 and inturned side flanges 8,8′, said channels 5,5′ opening toward each other and being maintained in spaced-apart relationship by transverse members and brackets, as generally shown at 9,10, respectively. Each of said inner extension members is of general I-form in cross-section, each having a central web 11 and forward and rearward edge flanges 12,13 extending beyond the opposite sides of web 11. As may best be seen in FIGS. 1 and 2, outer channels 5,5′ are so related to inner extension members 6,6′ that flanges 12,13 of the latter are respectively forwardly of flanges 8,8′ of the former. Disposed centrally of mast 4 is an upstanding elongated fluid cylinder 14 being suitably connected to a fluid pump (not shown) and a source of fluid (not shown); said cylinder having a piston 15 which is vertically reciprocally movable. Carried on piston 15, for movement therewith, adjacent its upper extremity, is a bracket 16 for supporting, on either side of said piston, a pair of sprockets (not shown) about each of which is trained a chain; as shown at 17,18, one end of each of which is fixed, as at 19, upon a plate 20. The other ends of said chains are engaged within bosses 21,22, respectively, formed on a carriage *c* (FIG. 6). Said carriage *c* comprises transversely extending, vertically spaced-apart, axially parallel upper and lower slide bars 23,24, respectively, with there being a pair of vertically extending, transversely spaced-apart rearwardly projecting plates 25,26 welded or otherwise secured to the rearward faces of said bars 23,24 in the central portions thereof. Each of said plates 25,26, respectively, carry said bosses 22,21 on their lower inner ends; and on their outward faces each mounts a pair of upper and lower guide rollers 27,28 for disposition proximate the inner face of the web 11 of the adjacent inner extension member 6,6', as the case may be; said rollers 27,28 being thus presented between the inner extensions of the flanges 12,13.

Said carriage *c* is engageable with the support frame *f* of side loader A which includes transversely spaced-apart vertical uprights 29,29' with there being a top plate 30 supported on said uprights 29,29' and extending forwardly thereof in cantilever fashion; said plate 30 being apertured as at 31,32 for weight reduction purposes; a transverse beam 33 is provided between uprights 29,29' in their upper portions. Extending between uprights 29,29' in their lower central portion is a hanger bar 34 having a co-extensive tongue 35 formed in its bottom surface for reception within a complementary recess 36 provided in the upper end of slide bar 23, through which interengagement side loader A is operatively connected to piston 15.

Figure 7:
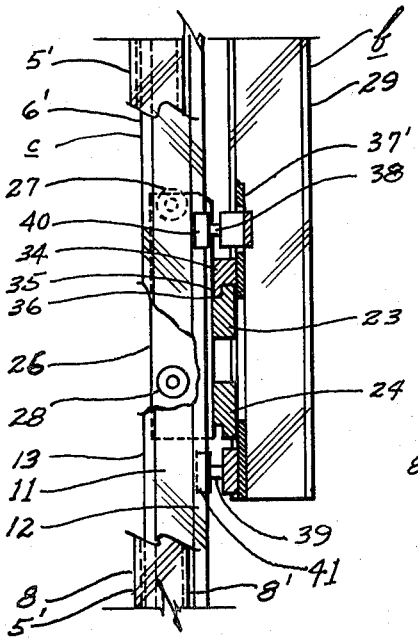
FIG. 7 is a vertical transverse sectional view taken on the line 7—7 of FIG. 6.
Figure 12:
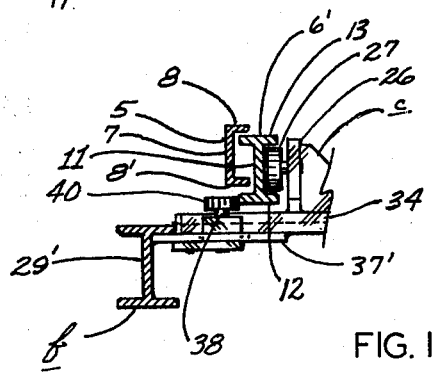
FIG. 12 is a horizontal transverse sectional view taken on the line 12—12 of FIG. 6.
Figure 11:
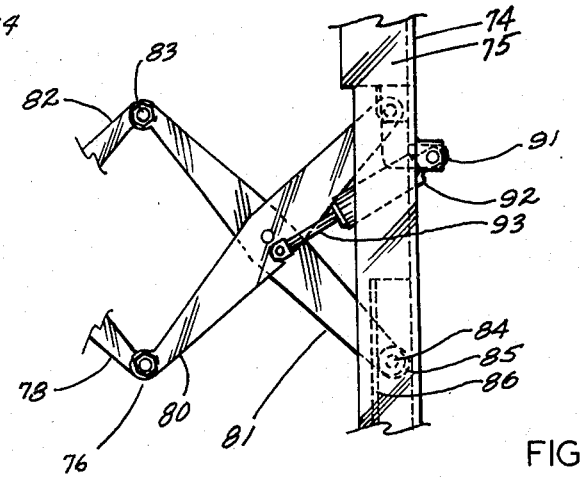
FIG. 11 is an enlarged fragmentary view of the reach mechanism of the present invention.

Each of said uprights 29,29', on their inner lower portions, are fixed, as by welding, to roller support frame portions 37,37', respectively, each of which carries upper and lower stub shafts 38, 39, respectively, for upper and lower stabilizer or thrust rollers 40,41, which latter engage on their periphery the outer and inner edges of forward flanges 12 of the proximate inner extension member 6, 6' (see FIG. 7).

Figure 1:
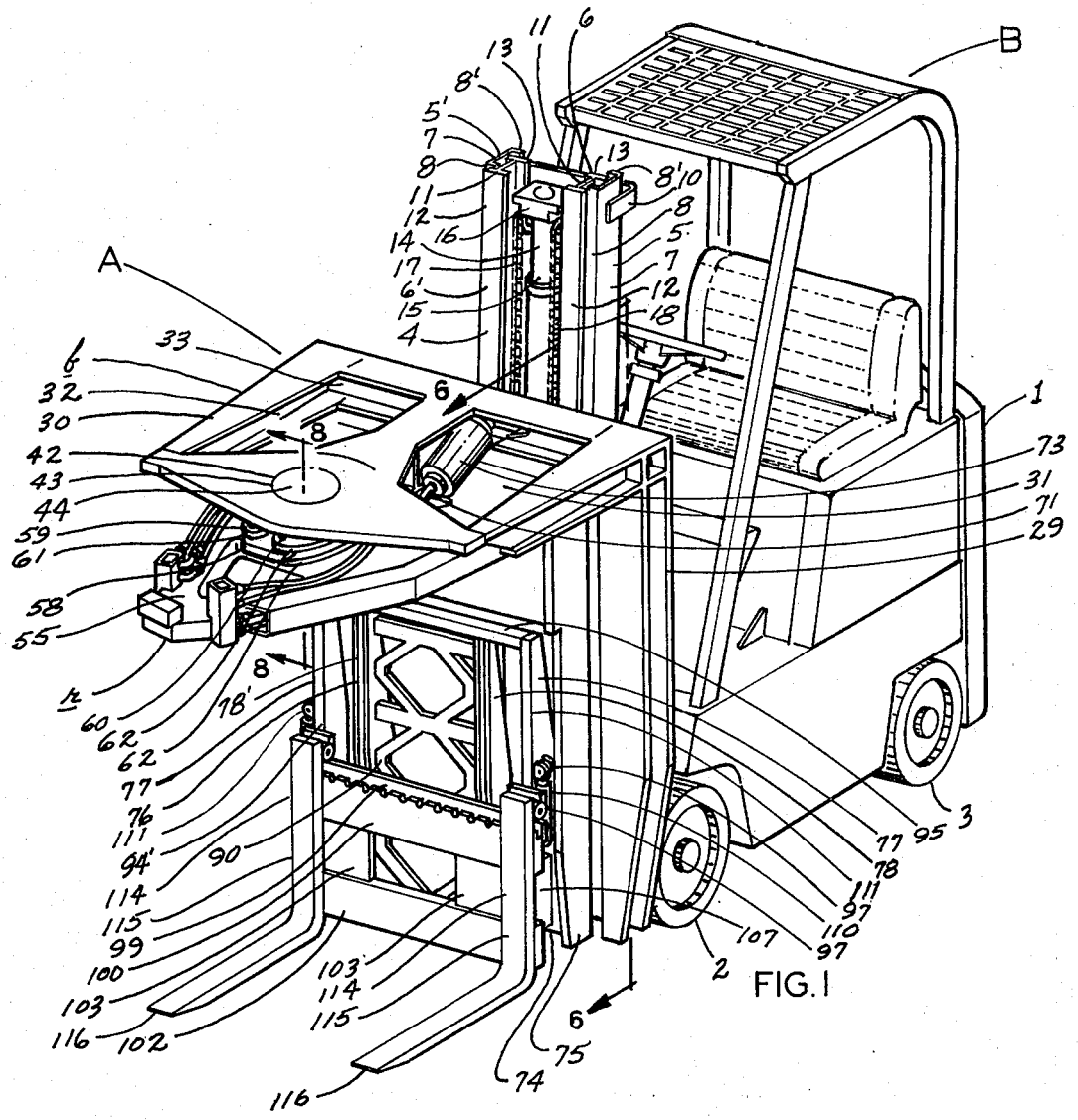
FIG. 1 is a perspective view of a side loader for fork lift trucks showing the fork lift truck with the side loader in lowered position.
Figure 8:
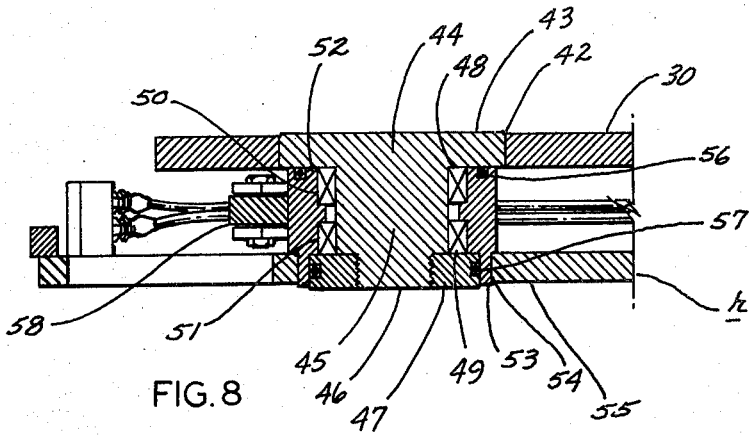
FIG. 8 is a vertical transverse sectional view taken on the line 8—8 of FIg. 1.
Figure 2:
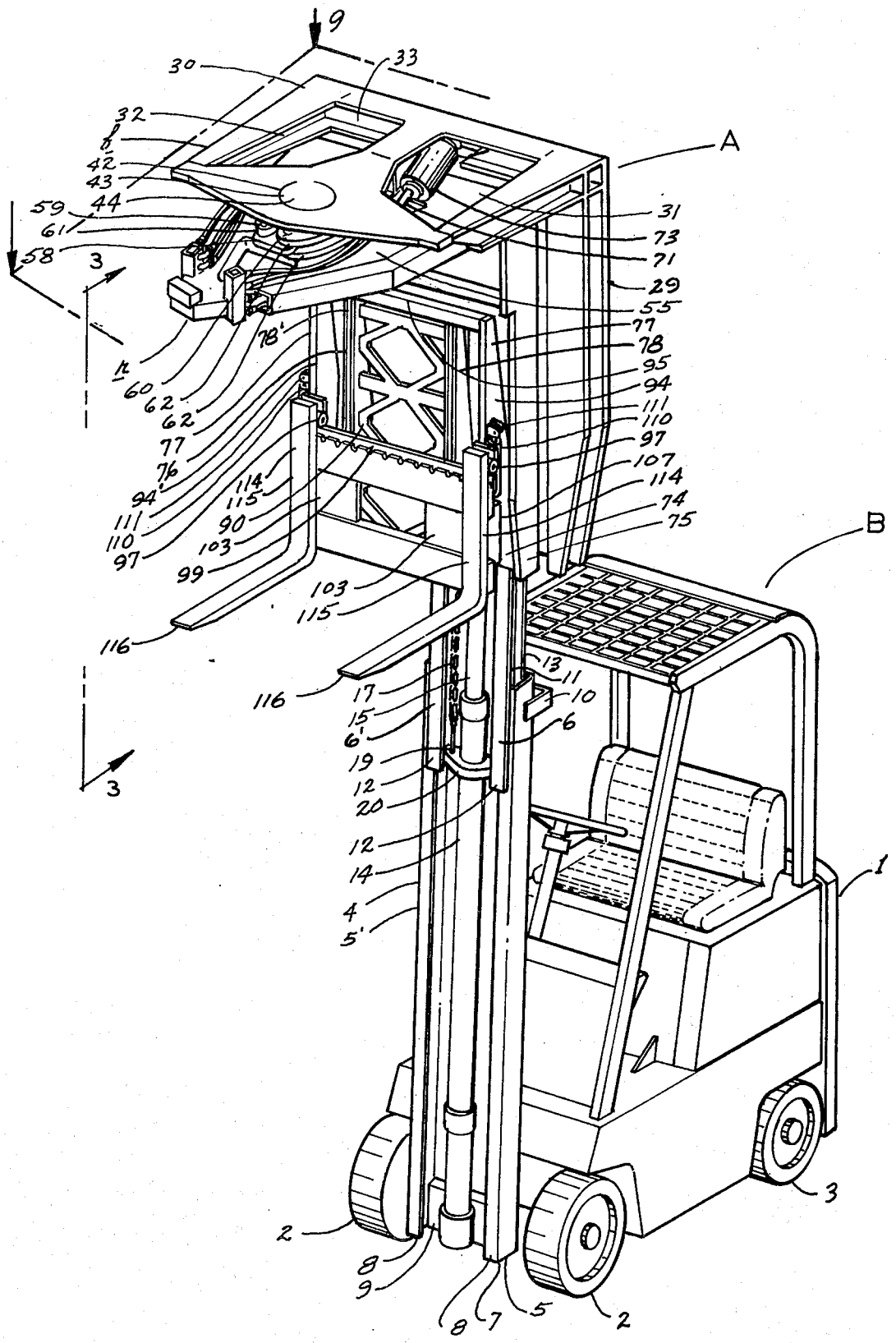
FIG. 2 is a perspective view illustrating the side loader in elevated disposition with respect to the fork lift truck.

Thus, with particular refence to FIGS. 1 and 2, with piston 15 in fully withdrawn condition, side loader A will be located at its lower end at ground level for load receiving purposes; and upon actuation said piston 15 will commence its upward stroke and chains 17,18 will, accordingly, cause carriage *c*, together with side loader A, to move upwardly relatively of mast 4. At a predetermined juncture in the upward stroke of cylinder 15, inner extension members 6,6' will effect interengagement with carriage *c* by customary means so that said carriage *c* and said members 6,6' will travel jointly until the upper limit of the piston stroke has been reached whereat side loader A will thus be in fully elevated condition, as shown in FIG. 2, for purposes to be described. Return of side loader A to lowered condition comprehends merely reverse operation to that just described. It is, of course, recognized that channels 5,5' or inner extension members 6,6' may optionally carry guide rollers (not shown).

Top plate 30 of side loader support frame *f* in its forward, central zone is provided with an annular opening 42 for receiving the upper, diametrically enlarged end 43 of an inner spindle 44 having a depending stem 45 which, at its lower end, is integral with an externally threaded projection 46 for engagement within the internal threads of a thrust collar 47 and at its upper end is suitably connected to top plate 30 as by welding. Presently circumferentially about stem 45 are load bearings 48,49, the outer portions of which are received within grooves 50,51 formed on the inner surface of an outer spindle 52 co-axial with stem 45; said outer spindle 52 is cross-sectionally reduced at its lower end, as at 53, for snug reception between the outer face of thrust collar 47, and the inner face of an opening 54 formed in the upper plate 55 of a rotative frame *r* of side loader A where outer spindle 52 is suitably secured as by welding to upper plate 55; it being noted that upper plate 55 of said frame *r* is located downwardly of top plate 30 and in planarwise parallel relationship thereto. Suitable sealing members, such as O-rings, 56,57, are provided within the spindle assembly.

Integral with outer spindle 52 and extending forwardly from the outer peripheral surface thereof is a boss 58 having a pair of openings in side-by-side relationship for receiving short vertical pivot pins 59,60, each of which latter are engaged to the inner ends of arcuate control arms 61,62, respectively. Said control arms 61, 62 are presented so that the same normally curve rearwardly and at their rearward ends are swingably connected to the forward ends of companion control arms 63,64, respectively, by pivot pins 65, 66, respectively, which arms 63,64 are of substantially like curvature as arms 61,62, and at their opposite or rearward ends are each engaged as by pivot pins 67,68, respectively, to an elongated boss 69 integral with beam 33 of frame *f* and projecting forwardly therefrom. Said control arms 63, 64 in their intermediate zone are secured to the outer ends of pistons 70,71, respectively, of fluid cylinders 72,73, respectively, which latter at their rearward ends are suitably mounted upon said beam 33. It is, of course, understood that said cylinders 72, 73 are conventionally connected to fluid conduits (which are but partially indicated in the drawings) and to pump means and a source of fluid supply. Said cylinders 72,73 are designed to operate simultaneously in reverse fashion so that while one is being extended for pushing action, the other is being withdrawn for pulling action for the purpose of effecting rotation of outer spindle 52 with consequent swinging of rotative frame *r* with respect to support frame *f*.

Figure 3:
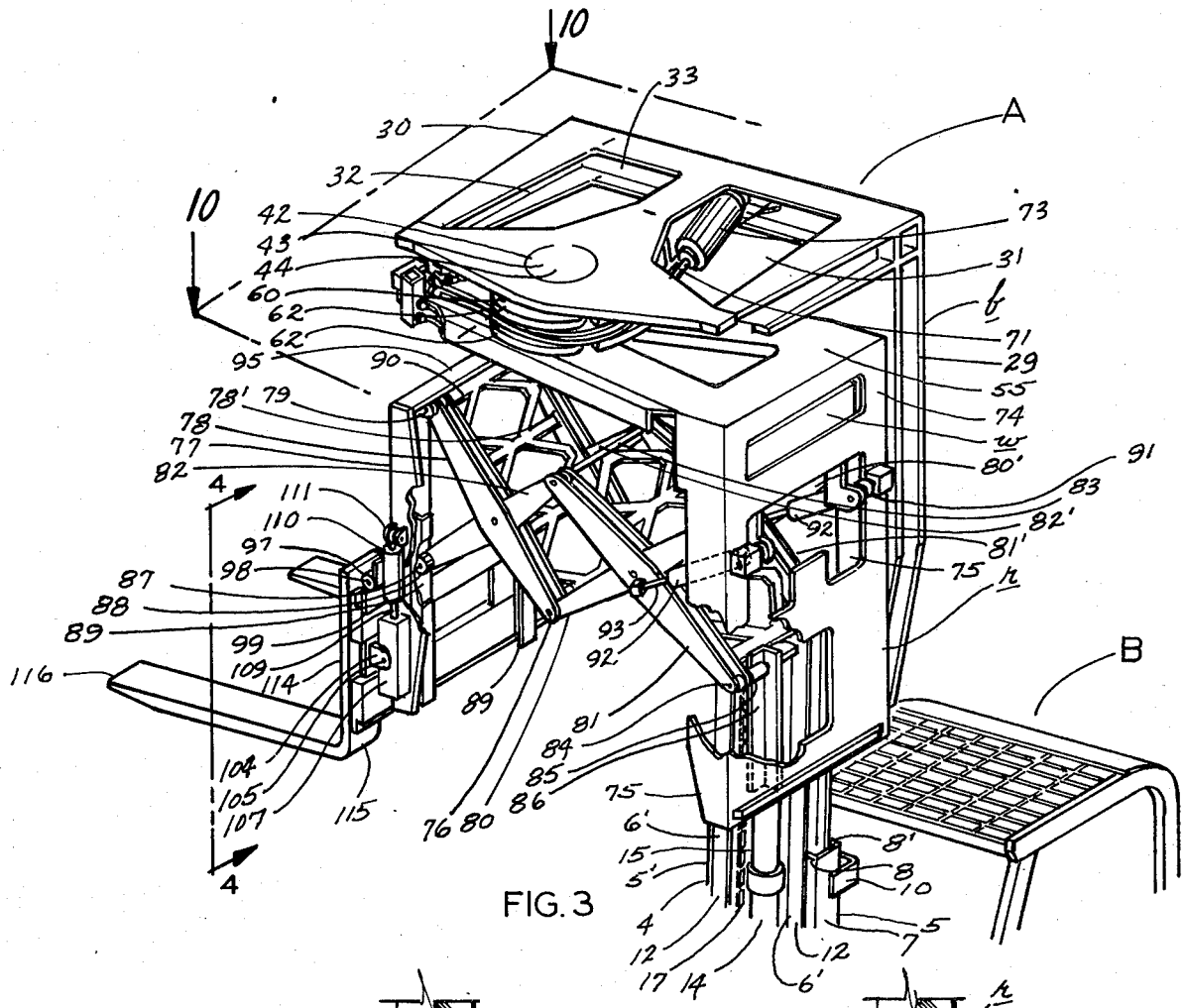
FIG. 3 is a perspective view of the loader taken substantially on the line 3—3 of FIG. 2 but showing the loader as rotated through an angle of 90° to the position shown in FIG. 2, and with the reach apparatus extended.
Figure 4:
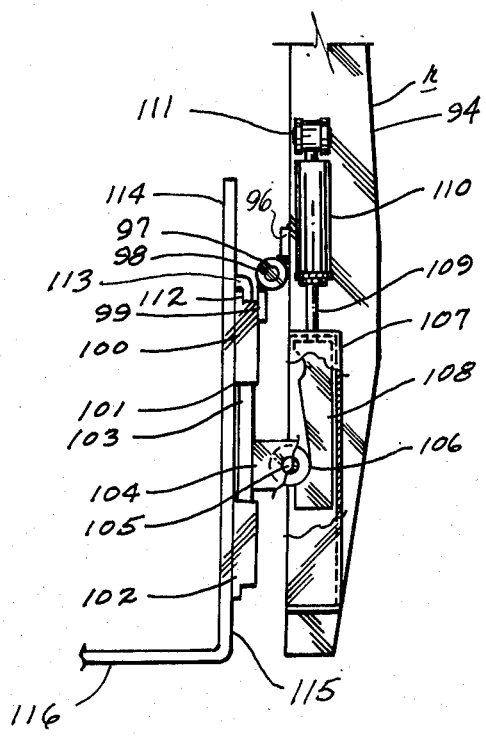
FIG. 4 is a fragmentary side elevational view taken on the line 4—4 of FIG. 3 illustrating the fork bars in horizontal position.
Figure 5:
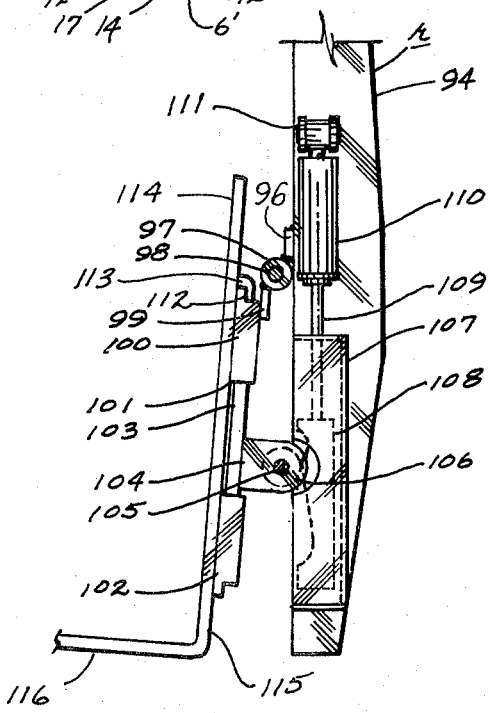
FIG. 5 is a fragmentary side elevational view taken substantially on the line 4—4 of FIG. 3 illustrating the fork bars in tilted position.
Figure 9:
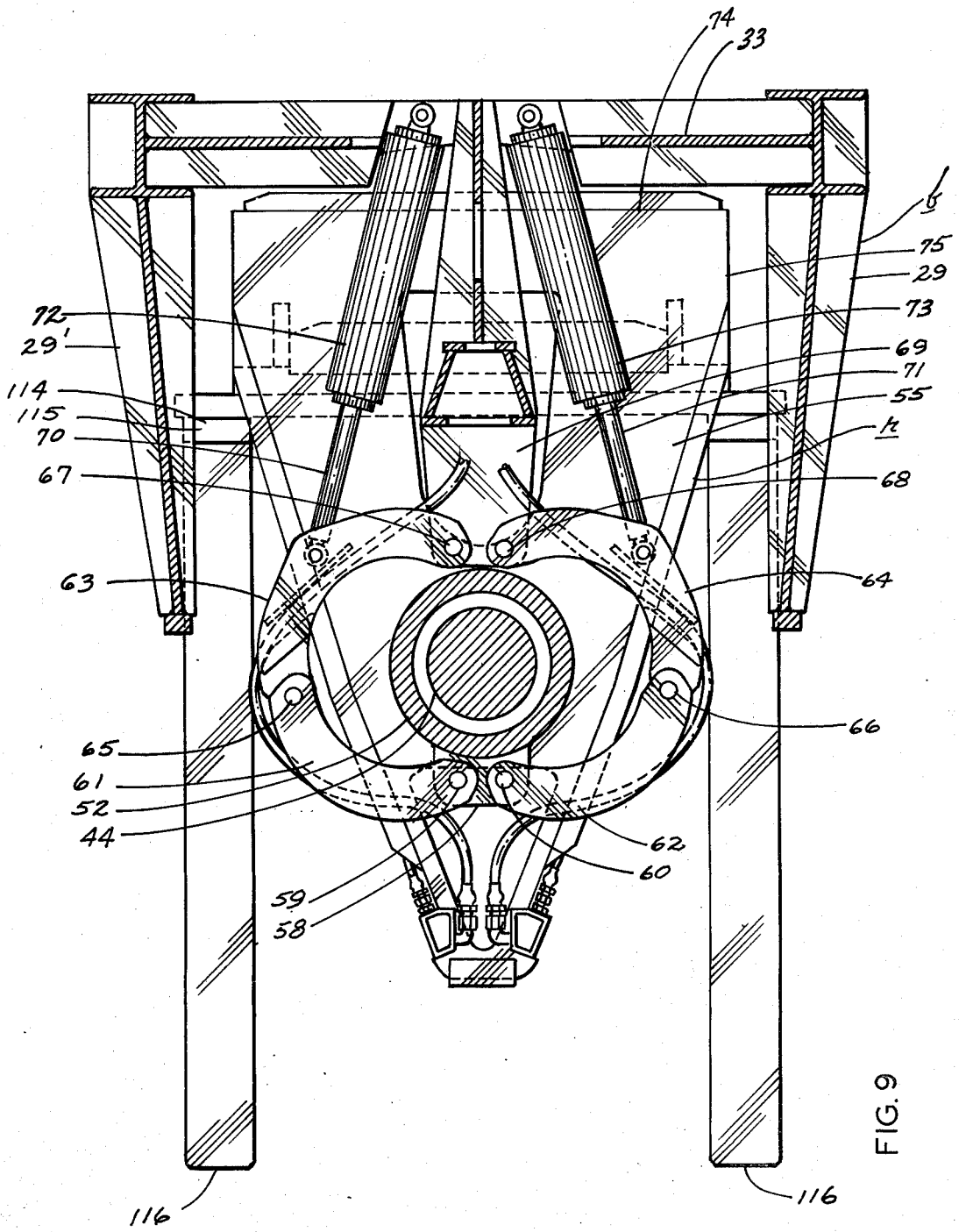
FIg. 9 is a horizontal transverse sectional view taken on the line 9—9 of FIG. 2.
Figure 10:
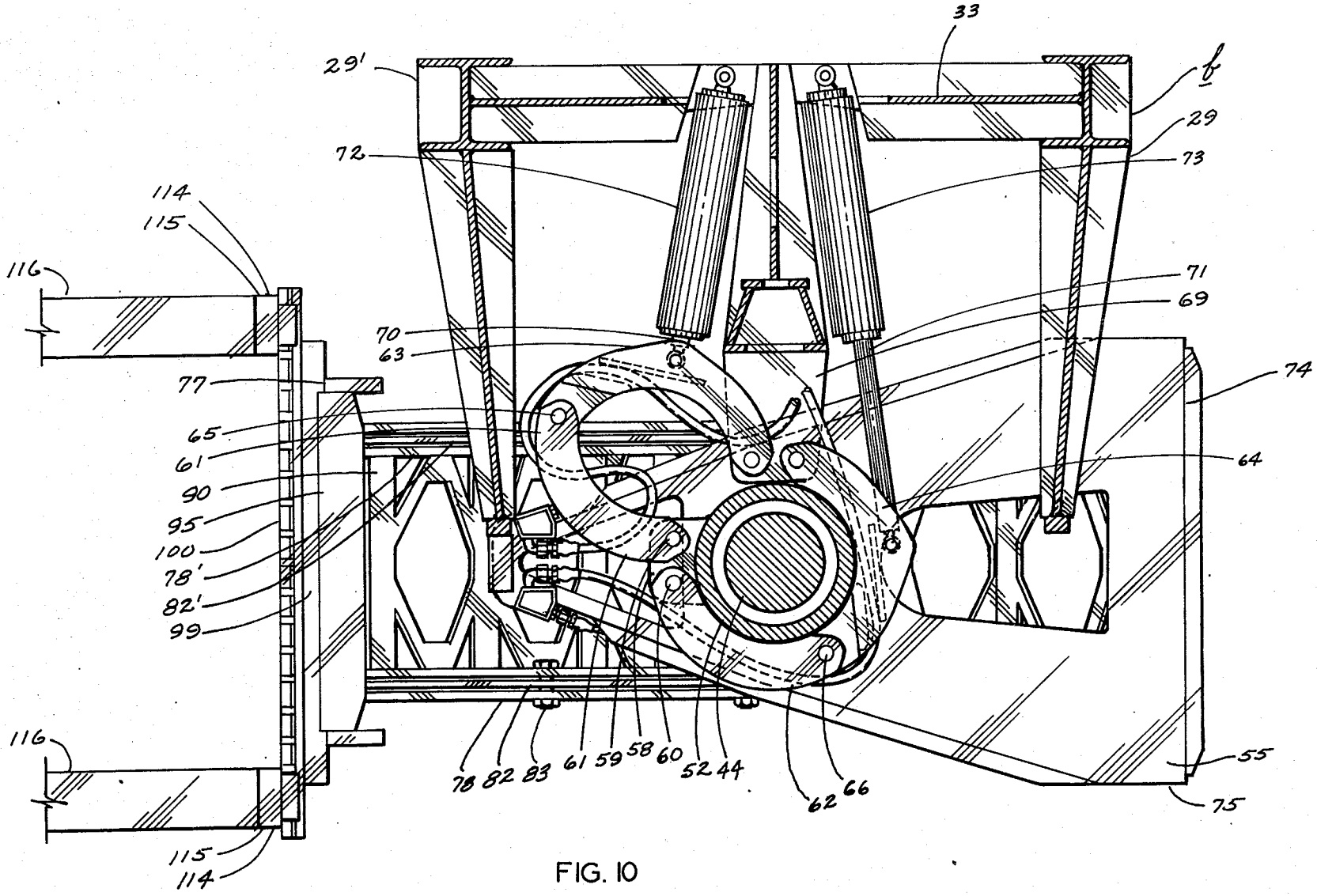
FIG. 10 is a horizontal transverse sectional view taken on the line 10—10 of FIG. 3.

With reference to FIGS. 9 and 10, it will be seen, for purposes of example, that if piston 71 is caused to be extended while piston 70 is being simultaneously withdrawn, outer spindle 52 may be rotated so as to cause rotative frame *r* to be swung through an arc of 90° as in the position shown in FIG. 3. Thus, boss 69 serves to anchor the two sets of control arms 62,64 and 61,63 so that the same may appropriately extend or contract depending upon the direction of swing. In other words, the cylinder adjacent the side to which rotative frame *r* is to be swung will effect a pulling action by retraction of its associated piston, while conversely the companion cylinder will be caused to extend its piston for effecting a pushing force. It is to be further observed that the fluid actuated rotational system of the present invention is compactly disposed between top plate 30 of frame *f* and upper plate 55 of rotative frame *r*.

Rotative frame *r* includes a back plate 74 which extends downwardly from the normally rear portion of upper plate 55 in perpendicular planar relationship thereto; said back plate having at its sides relative shallow forwardly directed flanges 75. Upper plate 55 projects substantially beyond back plate 74, being also in general cantilever relationship thereto. Carried, preferably, in the upper portion of back plate 74, mounted in any suitable fashion, is a counterweight *w* for purposes presently appearing. It is to be understood that counterweights could be provided on the upper portions of each of said flanges 75 if desired since it is critical for the proper operation of the present invention that rotative frame *r* be appropriately weighted within the zone indicated. As may best be seen in FIG. 3 back plate 74 is adapted to support a reach apparatus, indicated generally 76, for mounting at its normally outer end a fork bar frame 77. Reach apparatus 76 is of what generically might be considered as a lazy-tongs systems incorporating a pair of forward, transversely spaced-apart outer struts 78,78', which at their forward ends are engaged to a pivot rod 79 suitably supported in the upper portion of fork bar frame 77; said forward struts 78,78' at their opposite ends being each pivotally engaged to one end of a rearward inner strut 80,80' which latter at their opposite ends are pivotally engaged upon the upper inner surfaces of the proximate side flange 75. Said rearward inner struts 80,80' in their central zone are pivotally engaged to rearward outer struts 81,81', respectively, which latter at their forward or normally upper ends are suitably engaged to the upper or rearward ends of forward inner struts 82,82' as by means of a cross rod 83. At their opposite ends each of said rearward outer struts 81,81' carries a short transverse shaft 84 for mounting guide rollers 85 disposed within vertical ways 86 mounted upon the lower inner face of back plate 74. In similar fashion, the forward or normally lower ends of forward inner struts 82,82'mount short transverse shaft 87 carrying guide rollers 88 for reception within ways 89, supported on fork lift frame 77. It is seen that reach apparatus 76 is rigidified by means of frame sections 90 located between the struts and fixed thereto; said frame sections 90 being of open character for weight reducing purposes. Supported on the inner face of back plate 74 adjacent each flange 75 thereof is a mounting, generally indicated 91, for pivotal engagement to the rearward end of a fluid cylinder 92 accommodating a piston 93, the outer or forward end of which is suitably engaged to a projection formed on the proximate rearward outer strut 81,81', as the case may be, proximate the connection of the latter to the adjacent rearward inner strut 80,80', respectively. It is understood that said cylinders 92 are provided with customary fluid conduits for effecting extension and retraction of the associated piston 93 with there being the usual pump and fluid source, neither of which is shown. Accordingly, upon fluid being directed to cylinders 92 for extending pistons 93 said reach apparatus will be extended, as shown in FIG. 3, for locating fork bar frame 77 in outer or remote relationship to back plate 74. Conversely, upon retraction of pistons 93, reach apparatus 76 will, as it were, collapse into compact position adjacent plate 74 whereby fork lift frame 77 is drawn returningly inwardly beneath upper plate 55. The extending and withdrawing action of the component struts of reach apparatus 76 is permitted by virtue of the movement of guide rollers 85 and 88 within their respective ways 86, 89. Thus, by appropriate actuation of cylinders 92 reach apparatus 76 will be extended or withdrawn in a reliable manner.

Fork bar frame 77 comprises a pair of vertically presented, transversely spaced-apart side pieces 94,94' being connected at their upper ends to a cross member 95. On each of the side pieces 94,94' in their forward lower portion is a hinge plate 96 being rigid with the respective side space 94,94' and having secured thereto on their lower edges aligned hinged knuckles, as at 97, for receiving a horizontally presented pivot rod 98; said knuckles 97 also being secured to an elongated, but vertically short, leaf 99, which latter is rigid throughout its length with the upper back plate 100 of a fork bar support, generally indicated 101, which includes a lower back plate 102 spacedly downwardly from upper back plate 100 and parallel therewith. Interconnecting said upper and lower back plates 100,102, being rigid therewith as by welding, and on opposite sides of said support 101, are panels 103 which serves both as spacers as well as for mounting on their rearward faces a rearwardly extending boss 104 presented laterally outwardly of the adjacent side pieces 94,94'. Each boss mounts a short shaft 105 which carries on cam follower 106 engaging, as within a housing 107, a wedge cam 108 carried on the lower end of a vertically reciprocal piston 109, the upper end of which, upwardly of housing 107, is carried within a fluid cylinder 110 swingably mounted at its upper end, as at 111, upon the outer face of the adjacent side piece 94,94'. Said upper back plate 100 in its upper edge portion is suitably recessed, as at 112, to permit of facile engagement with a tongue or dog member 113 fixed on the rearward face of the vertical arms 114 of fork bars, customarily two, 115, being angulated to provide the usual tines 116 at its lower end. Accordingly, fork bars 115 may be easily adjusted transversely of fork bar support 101 for reception within the openings of the particular pallet to be handled.

Cylinders 110 are likewise connected to an appropriate source of fluid so that upon actuation piston 109 may be moved between upper or withdrawn position wherein the fork bars 115 will be in normal, non-tilted condition by reason of the cam followers 106 being accepted within the lower ends of cams 108 and lower or extended position wherein fork bars 115 will be tilted so that tines 116 will be upwardly inclined toward their outer ends by reason of cam followers 106 engaging the upper portions of the cams 108.

In view of the foregoing, the general operation of side loader A should be apparent. Thus, with a palletized load carried upon fork bars 115, and with side loader A in lowered position, truck B will be driven to the particular storage location. Thereupon cylinder 14 will be actuated for causing piston 15 to extend upwardly to the desired height. Thereupon, cylinders 72,73 will be actuated for causing a swinging of rotative frame *r* to one side or the other of the truck for presenting the load to the storage space. The next step is the actuation of cylinders 92 for causing reach apparatus 76 to be extended to the requisite length for presenting the load to the particular space. The operation is then reversed so that retraction of reach apparatus 76 will cause a withdrawl of fork bars 115 from the load to complete the transfer of the same to the particular storage location. Rotative frame *r* is swung returningly to cause fork bars 115 to be directed forwardly and thereupon side loader A is lowered upon descent of piston 15. The side loader of the present invention is uniquely constructed for appropriate co-ordination with truck B to assure of the development of effective forces for resisting truck tipping by reason of moving loads laterally of the truck centerline and at substantial height. It will be seen that top plate 30 of the fixed frame *f* will normally extend forwardly of the center of a load disposed upon the fork bars 115 when the latter projects forwardly as in the normal position (see FIGS. 1 and 2). The axis of inner and outer spindles 44,52 is perpendicular to the longitudinal centerline of truck B. During swinging of side loader A, frame *f* is stationary, while rotative frame *r* is swung, but by reason of its peculiar construction the major portion of the weight of the same does not move outward with the movement of the applied load to the side. During the operation of reach apparatus 76 back frame 74, together with counterweight *w*, is stationary and is located on the opposite side of the truck centerline from that to which reach apparatus 76 is being moved. To permit of substantial extension of reach apparatus 76 with a marked load for conducing to the versatility of side loader A, a requisite restoring moment must be provided to resist any tendency of the truck to tip laterally from a line through the truck ties, at floor level, upon the side of which the load is being moved. Thus, the combined center of gravity of truck B, side loader A, and the load must be located inwardly of such line and with the greater the distance therefrom, the greater will be the restoring moment. Accordingly, the counterweight *w* provided on back frame 74 serves to stabilize the rotative frame *r* as well as assuring of the desired location of the aforesaid combined center of gravity to present an adequate restoring moment. Thus, whether the rotative frame moves one way or the other, back frame 74 serves as a counterbalance. All of the weight of side loader A on the side of the center of rotation opposite that to which the load is being directed is utilized for counterweight purposes, resulting in a relatively increased load capability with loader A in extended position, and with the size and weight of the truck being capable of reduction from that which would otherwise be required for producing a stabilizing restoring moment.

Additionally, by reason of these unusual structural relationships, the normal binding forces between carriage *c* and mast 4 are reduced so that the same can be resisted by the guide and stabilizer rollers above described in lieu of the heavy, complex rack and pinion or chain mechanisms currently used.

The tiltability of fork bars 115 by coaction between cam followers 106 and wedge cams 108 serve to prevent any accidental displacement of the load by reason of a downward force upon such bars when in their full extended position as well as to generally maintain the load securely.

From the foregoing it is to be especially observed that side loader A constitutes an independent or unitary structure which is adapted for mounted disposition upon the mast of conventional fork lift trucks. Carriage *c*, as above described, is a usual component of the mast assembly of the fork lift truck and thus frame *f* of side loader A is easily engaged upon such carriage through the interfit of the upper slide bar 23 and hanger bar 34. The side loaders of the present invention provide an accessory which has not been heretofore attainable since prior constructions have comprehended specially constructed trucks with permanently installed side loaders conducing to extreme costlines, as well as complex structures.

The foregoing describes a preferred embodiment of the present invention. However, it must be recognized that it is within the scope of the present invention to present support frame *f* in reversed relationship to that described wherein erstwhile top plate 30 would constitute a bottom plate and with uprights 29,29' extending upwardly therefrom and with rotative frame *r* being thus located upwardly of erstwhile top plate 30 and adapted for rotation with respect thereto by the same means and structure as hereinabove described. With this reversed arrangement back plate 74 will thus extend upwardly from erstwhile rotative frame *r* but be presented in the same relative position as set forth. Thus, rotative frame *r* will rotate about a vertical axis with respect to the now reversed support frame *f* in the same identical manner as that described. Clearly carriage *c* will be engageable with support frame *f* in the same manner as with the structure in the condition shown in the drawings.

Consequently, mere reversing of the side loader A will effect no change in the operation of reach apparatus 76 nor of the fork bar support 101 with its associated structure.

Therefore, it is quite evident that such modification is well within the scope and spirit of the present invention.

Having described our invention, what we claim and desire to obtain by letters patent is:

1. A side loader for use with fork lift trucks comprising a first support frame, a second frame, means for mounting said second frame on said first frame and for providing swingable movement of the latter about a vertical axis, a reach apparatus mounted on said second frame for extending and retracting movement along an axis normal to the swing axis of said second frame, said reach apparatus having a normally outer end, and a fork bar support frame carried upon said outer end of said reach apparatus; said means including first and second control linkages, each having one end pivotally secured to said first frame and each having an opposite end pivotally secured to said second frame, first and second selectively extensible elongated members having one end pivotally connected to said first and second control linkages respectively and the opposite ends thereof pivotally connected to said first frame whereby extension of said first extensible member and corresponding retraction of said second extensible member causes rotation of said second frame in one direction, and extension of said second extensible member and corresponding retraction of said first extensible member causes rotation of said second frame in the direction opposite said one direction.

2. A side loader as defined in claim 1 and further characterized by said first support frame having a top plate, said second frame having an upper plate in downwardly spaced, planarwise parallel relationship to said first frame top plate and said means mounting said second frame including an inner spindle member carried by said first frame and an annular outer spindle member on said second frame rotatably supported around said inner spindle member, a first boss member carried by said outer spindle member and extending radially outwardly therefrom, a second boss member on said first support frame, and said opposite end of each of said control linkages being pivotally connected to said first boss member and said one end of each of said control linkages being pivotally connected to said second boss member.

3. A side loader as defined in claim 2 and further characterized by each of said control linkages including a first and a second rigid link, each of said first links being pivotally connected to said first boss member and each of said second links being pivotally connected to said second boss member, said first and second links of respective control linkages being pivotally connected together, and each of said extensible members being pivotally connected between said first frame and a respective one of said second links at a point spaced from the respective pivotal connection of said second link to said second boss member.

4. A side loader as defined in claim 3 wherein said first and second extensible members comprise fluid actuated cylinders.

5. A side loader as defined in claim 3 wherein each of said rigid links includes an arcuate transverse side facing said outer spindle member to permit said control linkages to extend partially around said outer spindle when the respective one of said extensible members is extended.

6. A side loader as defined in claim 1 and further characterized by said second frame having a horizontally disposed plate, a back plate extending from one side of said horizontally disposed plate in planar perpendicular relationship thereto, said reach apparatus having a normally inner end mounted upon said back plate.

7. A side loader as defined in claim 6 and further characterized by said back plate having one side face directed toward said horizontally disposed plate, and said reach apparatus inner end being engaged upon said one side face of said back plate.

8. A side loader as defined in claim 7 and further characterized by said back plate being outwardly radially spaced from the swing axis of said second frame.

9. A side loader as defined in claim 8 and further characterized by a counterweight being mounted upon said back plate and being of such weight as to at least partially counteract the weight of such reach apparatus and a load carried upon said fork bar support frame.

10. A side loader as defined in claim 1 and further characterized by said first support frame having a top plate, said second frame having an upper plate and a back plate, said back plate being in planarwise normal relationship to said upper plate and depending from one edge thereof, said means for mounting said second frame being a spindle extending between said top plate and said upper plate for establishing a vertical swing axis, said back plate being radially outwardly of said swing axis, and fork bars adjustably mounted on said fork bar support frame.

11. A side loader as defined in claim 10 and further characterized by said back plate having an inner face and an outer face, said inner face confronting the volume beneath said upper plate, said reach apparatus having a normally inner end and outer end, said reach apparatus being mounted at its inner end upon the inner face of said back plate for extending and retracting movement along an axis normal to the plane of said back plate, and fluid actuated means engaging said fork bars for tilting thereof.

12. A side loader as defined in claim 11 and further characterized by a counterweight mounted upon the outer face of said back plate for at least partially offsetting the weight of said reach apparatus and any load carried upon said fork bars.

13. In combination with a fork lift truck having a mast, a carriage mounted on said mast for movement therewith and means for elevating and lowering said mast, a side loader comprising: a first frame, means interengaging said first frame and said carriage for rendering said side loader movable with said mast, a second frame, rotative means suspending said second frame from said first frame and rendering same swingable about a vertical axis, a reach apparatus mounted on said second frame for extending and retracting movement along an axis normal to the said swing axis, a fork bar support frame carried upon said reach apparatus and load-receiving fork bars adjustably mounted on said fork bar support frame, said rotative means including first and second control linkages, each having one end pivotally secured to said first frame and each having an opposite end pivotally secured to said second frame, first and second selectively extensible elongated members having one end pivotally connected to said first and second control linkages respectively and the opposite ends thereof pivotally connected to said first frame whereby extension of said first extensible member and corresponding retraction of said second extensible member causes rotation of said second frame in one direction, and extension of said second extensible member and corresponding retraction of said first extensible member causes rotation of said second frame in the direction opposite said one direction.

14. The combination defined in claim 13 and further characterized by said swing axis and the longitudinal axis of said mast being parallel.

15. The combination defined in claim 14 and further characterized by said first stationary frame having a top plate, said second frame having an upper plate in downwardly spaced, planarwise parallel relationship to said top plate, said suspension means being a spindle extending between said top plate and said upper plate, a back plate depending from said upper plate, said reach apparatus having a normally inner end, and means mounting said reach apparatus at its inner end upon said back plate.

* * * * *